US006543397B2

(12) United States Patent
Sandberg et al.

(10) Patent No.: US 6,543,397 B2
(45) Date of Patent: Apr. 8, 2003

(54) LIMITATION OF CONTROLLABLE OPERATING PARAMETERS IN AN ENGINE

(75) Inventors: Lars Sandberg, Göteborg (SE); Martin Litorell, Göteborg (SE)

(73) Assignee: Volvo Car Corporation, Göteborg (SE)

( * ) Notice: Subject to any disclaimer, the term of this patent is extended or adjusted under 35 U.S.C. 154(b) by 0 days.

(21) Appl. No.: 09/682,799

(22) Filed: Oct. 19, 2001

(65) Prior Publication Data

US 2002/0022911 A1 Feb. 21, 2002

Related U.S. Application Data

(63) Continuation of application No. PCT/SE00/00639, filed on Apr. 4, 2000.

(30) Foreign Application Priority Data

Jan. 19, 1999 (SE) ..... 9901369

(51) Int. Cl.[7] ..... F02D 41/02; F02D 41/14

(52) U.S. Cl. ..... 123/41.15; 123/674; 123/676; 123/568.17; 123/690; 123/479; 701/107; 701/114

(58) Field of Search ..... 123/41.15, 674, 123/676, 689, 690, 479, 568.17; 701/107, 114

(56) References Cited

U.S. PATENT DOCUMENTS

| | | | | |
|---|---|---|---|---|
| 4,181,944 A | * | 1/1980 | Yamauchi et al. | 701/108 |
| 4,711,200 A | | 12/1987 | Kinoshita | 123/492 |
| 4,742,476 A | * | 5/1988 | Schwartz et al. | 701/30 |
| 4,953,351 A | * | 9/1990 | Motz et al. | 60/285 |
| 5,158,063 A | | 10/1992 | Hosoda et al. | 123/676 |
| 5,303,168 A | | 4/1994 | Cullen et al. | 364/557 |
| 5,857,163 A | | 1/1999 | Trombley et al. | 701/101 |
| 6,266,587 B1 | * | 7/2001 | Guertler et al. | 701/30 |
| 6,390,081 B1 | * | 5/2002 | Novak et al. | 123/676 |
| 6,463,380 B1 | * | 8/2002 | Ablett et al. | 701/100 |

FOREIGN PATENT DOCUMENTS

EP 0507500 B1 4/1995

* cited by examiner

*Primary Examiner*—Gene Mancene
*Assistant Examiner*—Arnold Castro
(74) *Attorney, Agent, or Firm*—Howrey, Simon Arnold & White LLP

(57) ABSTRACT

The invention relates to a method for limitation of at least one controllable operating parameter that can cause ageing of at least one component or one material in connection with an engine. The method includes the steps of determination of a maximum limit value allowed regarding the operating parameter and control of the engine so that the limit value is not exceeded, thereby limiting ageing of the component or material. The invention includes continuous determination of a measure that corresponds to the degree of impairment of the component that depends on ageing, wherein said determination of the limit value is made depending on the measure. The invention also relates to an arrangement for accomplishing this method. By means of the invention, an improved method and arrangement is provided for limitation of ageing of components and materials that, in particular, are arranged in connection with a combustion engine in a vehicle, thereby providing improved fuel consumption, improved emissions and improved performance of the vehicle.

7 Claims, 2 Drawing Sheets

LIMITATION OF CONTROLLABLE OPERATING PARAMETERS IN AN ENGINE

CROSS REFERENCE TO RELATED APPLICATIONS

The present application is a continuation of International Application No. PCT/SE00/00639, filed Apr. 4, 2000, which claims priority to Swedish Application No. 9901369-0, filed Apr. 19, 1999.

BACKGROUND OF INVENTION

1. Technical Field

The present invention relates to improving the aging characteristics of automobile components. More specifically, the invention relates to a method and arrangement for limitation of at least one controllable operating parameter that can cause ageing of at least one component or one material arranged in connection with an engine.

2. Background Art

In the field of motor vehicles such as passenger cars, various components occasionally gradually impair due to, among other things, ageing and wear. In order to prevent or delay ageing and the consequential non-functional ability of a certain component too early in the life cycle of a vehicle or the component, limits are commonly defined for certain operating parameters during operation of the vehicle. In doing so, the component in question can be protected and its life cycle enhanced.

One example of a component that is exposed to ageing and impairment, and therefore the risk of non-functioning, is an exhaust manifold arranged in connection with a combustion engine. The exhaust manifold guides exhaust gases out of the combustion engine to the environment by way of a rear exhaust system. Due to ageing and occasionally high temperatures, the exhaust manifold may be gradually subjected to disintegration and impaired function. In order to reduce the risk of non-functioning of the exhaust manifold, a limitation can be defined with respect to the temperature of the exhaust gases that flow out of the engine and through the exhaust manifold. In this manner, a premature impairment of its function is prevented.

According to known techniques, this exhaust gas temperature limitation can be accomplished by limiting engine output power or by limiting the supply of a rich fuel mixture to the engine. This can be controlled by a computer-based control unit available for the vehicle in question. However, one drawback regarding this method is that the maximum limit allowed for the exhaust gas temperature must be broadly set so that the worst possible operating situation is taken into consideration. For example, one such extreme operating situation occurs when a particularly active driver frequently drives the vehicle at very high loads and engine speeds. Thus, the limitation regarding exhaust gas temperature is broadly set so that functional incapability does not occur prematurely. Since limiting exhaust gas temperature requires a greater fuel supply, a limitation with a wide safety margin results in a comparatively high fuel consumption for the vehicle, which is a drawback.

As another example, it is known that motor oil in a combustion engine gradually degrades, particularly due to driving with comparatively high engine speeds and high torque from the engine. In this case, limiting the risk of impairment of the motor oil can be accomplished by maximizing the engine speed. This maximization can be accomplished by a computer-based control unit. More precisely, compulsory control of the engine speed is such that it never exceeds a certain limit corresponding to the risk of motor oil impairment. However, such a method can involve a drawback in the form of a perceived impaired performance of the vehicle.

One additional vehicle component where a similar limitation of a functional incapability is relevant is an exhaust catalyst. This is because the catalytic active surface of the exhaust catalyst decreases with age. Therefore, in order to insure that the exhaust catalyst function is not impaired prematurely, it is known to limit the temperature of the exhaust gases flowing through the exhaust catalyst.

Another operating parameter which can be limited in a vehicle is its output torque. According to European Patent No. 0507500, the output torque of an engine can be limited if certain predetermined parameters, such as the level and temperature of the coolant, the pressure and temperature of the motor oil, and the temperature of the air flowing into the engine, differ from certain predetermined limit values.

SUMMARY OF INVENTION

A primary object of the present invention is to provide an improved method for limitation of controllable operating parameters that can cause ageing of engine components and materials arranged in connection with an engine. This object can be accomplished by a method of continually determining a value that corresponds to the degree of impairment of the component or material affected by aging. This method includes determining a maximum limit value that is allowed with respect to at least one operating parameter, wherein the determination depends upon the continuously determined value. The object is also accomplished by an arrangement for limitation of at least one controllable operating parameter that can cause ageing of at least one component or one material in connection with an engine.

The invention provides a method for limiting at least one controllable operating parameter that can cause ageing of at least one component or one material associated with an engine. The method includes determining a maximum limit value allowable with respect to the operating parameter, and controlling the engine so that the limit value is not exceeded, thereby limiting ageing of the component or material. The invention includes continuously determining a value corresponding to the degree of impairment of the component susceptible to or affected by ageing, wherein the determination of the limit value is made depending on the corresponding value.

Accordingly, the present invention is able to establish for at least one component a limitation of a predetermined, controllable operating parameter in the engine or the vehicle which causes ageing of that component or a certain material with the intention of limiting the ageing as well as determining the risk of functional incapability of that component or the material in question. Since this limitation is dependent on the degree of ageing for a given component and material, respectively, the present invention is able to improve the emissions, the fuel consumption and the performance of the vehicle.

Other advantageous embodiments of the invention will be apparent from the appended claims.

BRIEF DESCRIPTION OF DRAWINGS

The invention will be further described in the following with reference to preferred embodiments and to the appended drawings, in which.

DETAILED DESCRIPTION

Figure 1:
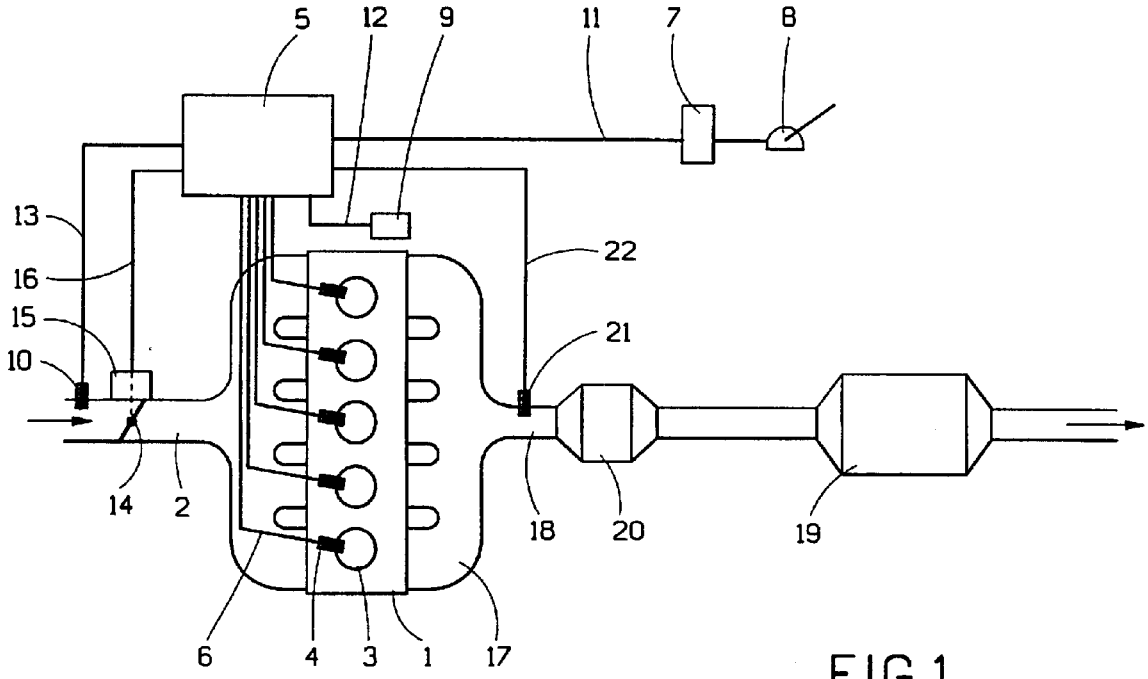
FIG. 1 is a schematic diagram of one embodiment of an arrangement in which the present invention can be utilized.

Referring to FIG. 1, a schematic view of an arrangement according to an exemplary embodiment of the present invention is illustrated. In a preferred embodiment, the invention is arranged in connection with a conventional gasoline combustion engine 1. In an alternative embodiment, the combustion engine 1 can be a diesel engine. In yet another alternative embodiment, the combustion engine 1 can be an electric motor.

According to a preferred embodiment illustrated in FIG. 1, an air inlet or intake supplies inflowing air to a combustion engine 1. The engine 1 includes a number of cylinders 3 and a corresponding number of fuel injectors 4. Each injector 4 is connected to a central control unit 5 via an electrical connection 6. Preferably, the control unit 5 is computer-based and is adapted to control the fuel supply to each injector 4 as known in the art. Thus the control unit 5 continuously controls the air/fuel mixture being fed to the engine 1. The engine 1 according to the embodiment is formed according to the "multi-point" injection type, where the correct amount of fuel to the engine 1 is individually supplied to each injector 4 in a known manner. As illustrated the engine is a five-cylinder engine, however it should be recognized that the invention can be utilized in engines having a variety of cylinders and a variety of cylinder configurations. Preferably, the injectors 4 are of the type where fuel is directly injected into the respective cylinder 3. However, the invention can also be utilized in port injected engines, as well as a single point injection where one single fuel injector is arranged in the engine inlet.

During operation of the engine 1, the control unit 5 controls the air/fuel mixture to the engine 1 so that the air/fuel mixture is adapted to the prevailing operating condition. The control of the engine 1 depends on various parameters which reflect the operating condition of the engine 1 and the vehicle in question. For example, the control of the engine depends on the prevailing degree of throttle application, the engine speed, the amount of injected air to the engine and the oxygen concentration in the exhaust gases. A position indicator 7 can determine the position of an accelerator pedal 8, an engine speed indicator 9 can detect the engine speed and an air flow meter 10 can detect the amount of air supplied to the engine 1, all of which are connected to the control unit 5 via corresponding electrical connections 11, 12 and 13, respectively. Furthermore, the system can also include a gas throttle 14 with a controllable shifting motor 15 for controlling the position of the gas throttle 14 thus controlling the amount of air being fed to the engine 1 depending on the prevailing operating condition. In a preferred embodiment, the shifting motor 15 electrically controls the gas throttle with the shifting motor 15 being connected to the control unit 5 via an electrical connection 16.

During operation of the engine 1, an exhaust manifold guides exhaust gases from the cylinders 3 to an exhaust pipe 18 connected to the manifold 17. Preferably, an exhaust catalyst 19 is provided further downstream along the exhaust pipe 18 and is typically a conventional three-way catalyst. A pre-catalyst 20 can also be arranged upstream of the exhaust catalyst 19. The pre-catalyst 20 is adapted for rapid heating during cold starts of the engine 1, i.e., so that the catalytic coating of the pre-catalyst becomes active more rapidly. This results in a considerable elimination of hydrocarbon ("HC"), carbon monoxide ("CO"), and nitrous oxide ("$NO_x$") compounds in the exhaust gases, particularly during low idle flows. Also, by rapidly heating the flowing exhaust gases, a comparatively short ignition time is provided for the subsequent exhaust catalyst 19, i.e., a comparatively short time that passes until the exhaust catalyst 19 has been heated to a temperature in which a predetermined amount of harmful substances in the exhaust gases can be reduced. This results in a more effective exhaust purification for the engine 1, particularly during cold starts.

Furthermore, the arrangement according to a preferred embodiment comprises a sensor 21 for detecting the oxygen concentration in the exhaust gases. Preferably, the sensor 21 is of the linear lambda sond type and is connected to the control unit 5 via an electrical connection 22. Preferably, the sensor 21 is arranged in the exhaust pipe 18, upstream of the pre-catalyst 20. However, other locations of the sensor 21 are possible, for example between the pre-catalyst 20 and the exhaust catalyst 19. The sensor 21 generates a signal corresponding to the oxygen concentration in the exhaust gases. This signal is fed to the control unit 5 and is used in controlling the air/fuel mixture to the engine 1.

The function of the invention will now be described with reference to an example in which a certain operating parameter is limited so that the ageing of the above-mentioned exhaust manifold 17 can be limited. In this manner, the risk of functional incapability of the exhaust manifold 17 can also be decreased. This is achieved by controlling an operating parameter such as the temperature T of the exhaust gases that flow out from the engine 1 and through the exhaust manifold 17. A similar limitation of the exhaust gas temperature T can be utilized for limiting a functional incapability of the pre-catalyst 20 and of the exhaust catalyst 19.

The exhaust gas temperature can be limited to a certain predetermined limit value to ensure that the temperature of a certain component in connection with the engine never gets so high that there is a risk of damage or causing functional incapability of the component in question. Examples of such temperature-critical components include the pre-catalyst, the exhaust catalyst critical components, the exhaust catalyst and the exhaust manifold. However, by limiting the temperature too rigidly can result in an unnecessarily high fuel consumption, increased HC and CO emissions and impaired performance of the engine. If a less rigorous limit is used, then there can be a comparatively faster ageing at the end of the life cycle, which limits the service life of the component.

Therefore a comparatively rigid limitation of a predetermined operating parameter (e.g., the exhaust gas temperature) is not always necessary, particularly not during the initial phase of the life cycle of a vehicle. Thus a continuous determination of a maximum limit value allowed for a predetermined operating parameter (e.g. the exhaust gas temperature) is made depending on a measurement corresponding to the continuous impairment of the component in question. In other words, according to the invention, a delimitation is made depending on to what extent the component can be considered to have aged in relation to a completely new component. The measure of the impairment or the ageing of the component in question can be estimated by calculating the number of driven kilometers, the number of starts, the number of operating hours or the amount of consumed fuel for the vehicle in question. This measurement can be provided by the control unit 5. Alternatively, the measurement can be determined using methods based on measurements with indicators.

Figure 2:
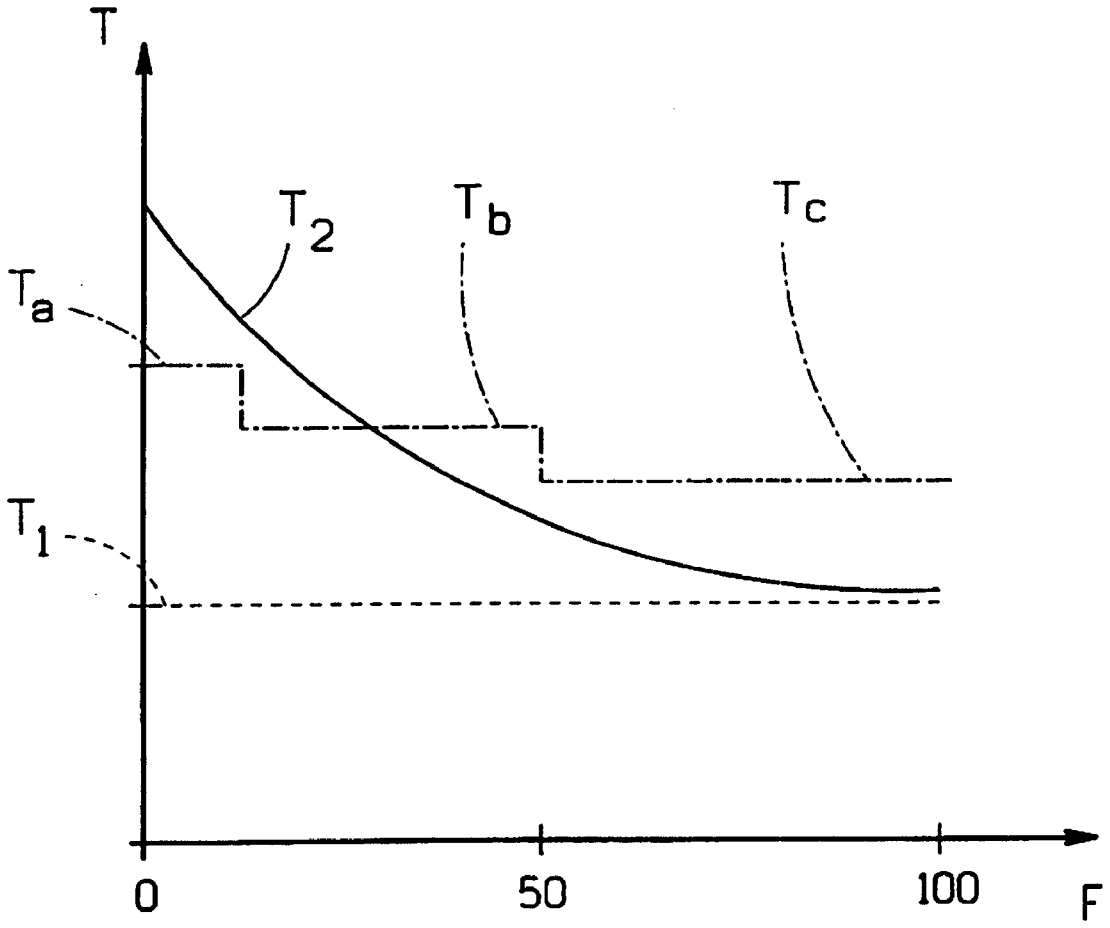
FIG. 2 is a graph which illustrates the function of the invention.

Referring to FIG. 2, a graph of the connection between a predetermined limit value for a certain operating parameter (indicated on the y-axis) and a measurement corresponding to the aging or the impairment F of a certain critical component, e.g., the "impairment factor" (indicated on the x-axis). An example of the operating component can be the exhaust gas temperature T. In a preferred embodiment, the impairment factor is a value between about 0 and about 100, where 0 corresponds to a completely new component fully capable of functioning, and where 100 corresponds to a worn-out component incapable of functioning).

In comparison with this, the graph shows a dashed line indicating a limit value $T_1$ which corresponds to previously known technique (i.e., a limit value which is defined with a very wide margin for the purpose of taking extremely hard conditions into consideration). Moreover, the unbroken line indicates how a limit value $T_2$ which depends on ageing or impairment can be defined in accordance with the invention. Since the latter limit value $T_2$ depends on the degree of impairment of the component in question, it is possible to define and utilize a comparatively high limit value $T_2$ of the exhaust gas temperature in the beginning of the life cycle of a vehicle, i.e. before a noticeable ageing of the component in question (e.g., the exhaust catalyst 19 or the exhaust manifold 17) has occurred. This implies that only a low degree of cooling of the exhaust gas temperature needs to be done in the beginning of the life cycle of the vehicle. This, in turn, results in that a comparatively small amount of fuel needs to be utilized in order to cool the exhaust gases at this stage, which influences the emissions, the fuel consumption and the performance of the vehicle in a positive direction.

Next, concurrently with the ageing or impairment in the components in question, a gradually lowered limit value $T_2$ can be utilized. In this case, such a gradually lowered limit value corresponds to an increasingly evident cooling of the exhaust gases. This is indicated by means of the unbroken curve in FIG. 2. The limit value 12 can be selected in various ways concurrently with the ageing of the respective component. A continuous, gradually decreasing change of the limit value $T_2$ can be utilized, which also is illustrated in FIG. 2. Alternatively, the exhaust gas temperature T can be limited so that a first limit value $T_a$ is set when the impairment factor for example is between about 0 and about 10, a second, slightly lower, limit value $T_b$ is set when the factor is between about 10 and about 50, and a third, additionally slightly lower, limit value $T_c$ is set when the factor is between about 50 and about 100. This results in a gradually decreasing limit value, illustrated by the dash dotted line in FIG. 2.

The invention is not limited in that the limit value $T_2$ gradually drops to a value which corresponds to the limit value $T_1$ which corresponds to previously known technique (compare FIG. 2). For example, there might be applications where the limit value $T_2$ according to the invention approaches a value which is lower or higher than the limit value $T_1$ according to known techniques.

Furthermore, the invention can be utilized for limitation of ageing of a material 15 in the form of the motor oil which is present in the engine 1. In such a case, a limitation of the engine speed of the engine 1 can be made. In this case, by analogy with what has been described above, a limit value $n_1$ is defined which depends on a measure related to the ageing or the impairment of the motor oil. For example, in the initial phase of the life cycle of the vehicle, a comparatively high limit value $n_1$ can be allowed, wherein the limit value $n_1$ gradually drops concurrently with an increasing impairment factor F. For example, by making a comparatively insignificant limitation of the engine speed during the initial phase of the life cycle of a vehicle, an improvement of the perceived performance of the vehicle is provided. In connection with a motor oil change in the vehicle in question, some form of resetting to zero of the system is required, which can be performed by a garage mechanic.

The invention is not limited to the embodiments which are described above and shown in the drawings, but may be varied within the scope of the appended claims. For example, the engine may be of the type which is provided with a turbo device. In such an application, the exhaust manifold is particularly exposed to a risk of functional incapability, which is due to the fact that very high temperatures in this case may occur in the exhaust manifold. Furthermore, the invention can be utilized for limitation of functional incapability by controlling several different operating parameters in connection with a combustion engine.

The invention is not limited to systems which comprise neither exhaust catalysts nor pre-catalysts, but can in principle also be applied to vehicles which are not provided with these components. Moreover, the invention can also be applied in connection with various types of engines, e.g., gasoline engines, diesel engines or electric motors, and in those propulsion systems that are based on a combination of a combustion engine and an electric motor, or a hybrid vehicle.

The invention is based on a control of operating parameters which result in ageing of components or materials. Examples of such operating parameters include the temperature in or in connection with the engine, the temperature of the exhaust gases, the output or indicated torque of the engine, and the engine speed. In this manner, the invention is utilized in order to limit the rate of ageing of the component or the material in question. In determining the limitation of relevant operating parameters, several components or materials may be taken into consideration, e.g., the combined effects of the ageing of various components may be taken into account.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

What is claimed is:

1. A method of limiting at least one controllable operating parameter that can cause ageing of at least one component or one material in connection with an engine, the method of limitation comprising the steps of:

determining a maximum limit value allowed regarding the operating parameter, and controlling the engine so that the limit value is not exceeded, whereby ageing of the component or material is limited, and continuously determining an impairment value which corresponds to the degree of impairment of the component dependent on ageing, wherein the determination of the limit value is made depending on the impairment value.

2. The method according to claim 1, wherein the operating parameter corresponds to the temperature of the exhaust gases emitted from the engine.

3. The method according to claim 1, wherein the operating parameter corresponds to the engine temperature.

4. The method according to claim 1, wherein the operating parameter corresponds to the engine torque.

5. The method according to claim 1, wherein the operating parameter corresponds to the engine speed.

6. The method according to claim 1, further comprising the step of selecting the limit value such that it is gradually decreasing concurrently with the degree of impairment of the component.

7. An arrangement for limitation of at least one controllable operating parameter that can cause ageing of at least one component or one material in connection with an engine, the arrangement comprising:

a control unit adapted for determining a maximum limit value allowed regarding at least one operating parameter, wherein the control unit is able to control the engine so that the limit value is not exceeded, wherein ageing of said component or material is limited, wherein the control unit is further able to continuously determine an impairment value that corresponds to the degree of impairment of the component affected by ageing, wherein the determination of the limit value is made depending on the impairment value.

* * * * *